US005482116A

United States Patent [19]

El-Rabaa et al.

[11] Patent Number: 5,482,116

[45] Date of Patent: Jan. 9, 1996

[54] WELLBORE GUIDED HYDRAULIC FRACTURING

[75] Inventors: A. Wadood El-Rabaa, Plano; Jon E. Olson, Dallas, both of Tex.

[73] Assignee: Mobil Oil Corporation, Fairfax, Va.

[21] Appl. No.: 165,072

[22] Filed: Dec. 10, 1993

[51] Int. Cl.[6] ..... E21B 43/26; E21B 47/00

[52] U.S. Cl. ..... 166/250.1; 166/50; 166/297; 166/308

[58] Field of Search ..... 166/50, 250, 297, 166/308

[56] References Cited

U.S. PATENT DOCUMENTS

| | | | |
|---|---|---|---|
| 4,635,719 | 1/1987 | Zoback et al. | 166/250 |
| 4,687,061 | 8/1987 | Uhri | 166/308 |
| 4,724,905 | 2/1988 | Uhri | 166/250 |
| 4,974,675 | 12/1990 | Austin et al. | 166/250 |
| 4,977,961 | 12/1990 | Avasthi | 166/297 |

OTHER PUBLICATIONS

Soliman et al., "Fracturing Aspects of Horizonal Wells", *Journal of Petroleum Technology,* Aug. 1990, pp. 966–973.

*Primary Examiner*—George A. Suchfield

*Attorney, Agent, or Firm*—Alexander J. McKillop; George W. Hager, Jr.

[57] ABSTRACT

Method of hydraulic fracturing of a subterranean formation comprising drilling a deviated wellbore in a direction parallel to a desired fracture direction, and supplying fracturing fluid through the wellbore to the formation. The average net pressure on the fluid is maximized in a fracture formed in the formation by pumping the fracturing fluid at a maximum rate, and by using a high viscosity fracturing fluid. Maximization of the average net pressure acts to extend the fracture in a direction parallel to the direction of the wellbore. The amount of the extension of the fracture is a function of the ratio of the average net pressure to the horizontal stress difference, whereby the higher the ratio, the greater the amount of the extension.

20 Claims, 4 Drawing Sheets

NORMALIZED RADIUS = R/L

WELLBORE GUIDED HYDRAULIC FRACTURING

BACKGROUND OF THE INVENTION

The present invention relates to hydraulic fracturing of subterranean formations. More particularly, the present invention relates to controlling the direction of the fracture irrespective of in situ stress orientation.

Many hydrocarbon-bearing formations are characterized by geological features that impart a directional permeability. The most common examples of these types of structures are permeable faults, joints, and micro-cracks. Low permeability formations are candidates for well stimulation. These fracture systems often provide avenues of extremely high conductivity compared to the rock matrix.

The orientation of natural fracture systems such as faults, joints, and micro-cracks is controlled by the in situ stress state at the time the fracture systems were formed. The formations may have occurred tens of thousands to millions of years ago. However, oil field experience in measuring present day in situ stress fields suggest that in most naturally fractured reservoirs, the stress orientation has not changed significantly since the formation of these natural fractures.

The orientation of induced hydraulic fractures is also controlled by the in situ stress state at the time of fracturing. A hydraulic fracture induced from a vertical well typically propagates perpendicular to the minimum horizontal stress. The minimum horizontal stress is also the orientation for most joints, micro-cracks and certain types of faults, specifically normal faults. Consequently, it is very unlikely that a conventional hydraulic fracture treatment will intersect many of the high permeability features of an anisotropic reservoir.

Recent advances in drilling technology have enabled operators to drill horizontal wells of considerable extent in a cross-fracture trend to tap natural fracture systems in formations such as the Austin Chalk with great success. However, in other situations, horizontal drilling alone has not resulted in production success. In formations where there is limited vertical conductivity, very low permeability or natural fractures of limited extent, special hydraulic fracturing techniques can provide an improvement in low production.

One such technique is sequential hydraulic fracturing as disclosed in U.S. Pat. No. 4,687,061 where fracturing fluid is supplied at a first depth in a deviated wellbore to propagate a first vertical fracture as favored by the original in situ stresses of the formation in a direction that is perpendicular to the least principal in situ stress (also known as minimum horizontal stress, $\sigma Hmin$). Fracturing fluid is then applied at a second depth within the wellbore while maintaining pressure in the first fracture to propagate a second vertical fracture through the formation in a direction parallel to the least principal in situ stress which should now be favored by the altered in situ stresses due to the first fracture. This second fracture thus intersects the naturally occurring fractures in the formation which are perpendicular to the direction of the least principal in situ stress, thereby linking the naturally occurring fractures to the wellbore to stimulate the production of oil and/or gas from the formation.

Another technique of sequential hydraulic fracturing is disclosed in U.S. Pat. No. 4,724,905 wherein a formation is penetrated by two closely spaced wellbores. A fracturing fluid is supplied to the first wellbore to generate a first hydraulic fracture in a direction perpendicular to the least principal in situ stress. While maintaining pressure in the first hydraulic fracture, a second hydraulic fracture is initiated in the second wellbore. Due to the alteration of the local in situ stresses by the first hydraulic fracture, the second hydraulic fracture is initiated at an angle, possibly perpendicular, to the first hydraulic fracture. Thus, the second hydraulic fracture has the potential of intersecting natural fractures not contacted by the first hydraulic fracture.

SUMMARY OF THE INVENTION

It is an object of the present invention to control the direction of a hydraulic fracture induced from a highly deviated, and preferably horizontal, well in order to propagate the fracture at least transverse to and preferably perpendicular to the high permeability trend of the reservoir. This direction is typically but not necessarily perpendicular to the main natural fracture trend. Such fracture provides communication with the existing high permeability features in the reservoir. As used herein, "highly deviated wellbore" means that the wellbore is at an angle from about 60 to about 120 degrees from the vertical.

An induced fracture initially tends to propagate a short distance parallel to the wellbore before proceeding, as noted above, in response to the in situ stress field to a direction perpendicular to the minimum horizontal stress, and thus parallel to the natural fracture trends and typically parallel to the high permeability trend of the reservoir.

The present invention provides for guiding the induced fracture to extend the distance it travels in the direction of the wellbore before the fracture propagates in a direction perpendicular to the direction of the minimum horizontal stress.

In accordance with a broad aspect of the present invention, there is provided a method of controlling the direction of a hydraulic fracture in a subterranean formation induced from a highly deviated wellbore comprising the steps of drilling a deviated wellbore in a direction parallel to a desired fracture direction, and supplying fracturing fluid through the wellbore to the formation. The average net treating pressure of the fluid in a fracture formed in the formation is maintained at a level at least greater than the maximum horizontal stress pressure less the minimum horizontal stress pressure.

However, it is preferred to maximize the average net treating pressure in the fracture by pumping the fracturing fluid at a maximum rate and by the fracturing fluid being a high viscosity in situ fracturing fluid. Maximization of the net treating pressure extends the fracture outwardly from the downhole and of the wellbore and in the direction of the wellbore. The amount of the extension of the fracture is a function of the ratio of net pressure to horizontal stress difference, whereby the higher the ratio, the greater the amount of the extension.

The invention also contemplates repeating the steps of the broad aspect of the invention to incrementally propagate the fracture still further beyond the downhole end of the wellbore. This aspect comprises monitoring the propagation of the fracture beyond the end of the wellbore, and performing the repeating steps after the fracture is at a maximum distance beyond the end of the wellbore. However, these steps may also be repeated after the fracture curves to a direction parallel to the direction of the high permeability trend of the formation, whereby local in situ stresses are altered after the fracture curves.

In cases where a horizontal wellbore is drilled in a direction other than perpendicular to the minimum horizontal stress, the induced fracture will still follow the wellbore and eventually will curve to become perpendicular to that stress component. However, a lower average net pressure is required to guide a fracture in a wellbore direction when that direction is not perpendicular to the miminum horizontal stress The guiding effect initially comes from the redistribution of in situ stresses around the wellbore. Analysis of the stresses around the wellbore has shown that the maximum tensile stress, i.e. where the fracture is initiated, is attained at two diametrically opposite points on the circular periphery of the wellbore. The loci of these points are two straight lines parallel to the directrix of the wellbore. In most situations, the maximum compressive in situ stress is the vertical direction, with the fracture initiation points existing along the high side and the low side of the wellbore, which guides a vertical fracture with a minimum extent equal to the wellbore and parallel to the wellbore.

In a cased wellbore, longitudinal arrays of perforations along the upper and lower portions of the casing will extend fracture guidance in the wellbore direction. In an openhole portion of a wellbore, notches along the upper and lower portions of the wellbore and in the direction of the wellbore will also extend fracture guidance in the wellbore direction. The present invention also contemplates wellbores the are partially cased and optionally perforated, with the open portion of the wellbore notched to an extent desired.

DESCRIPTION OF SPECIFIC EMBODIMENTS

Figure 1:
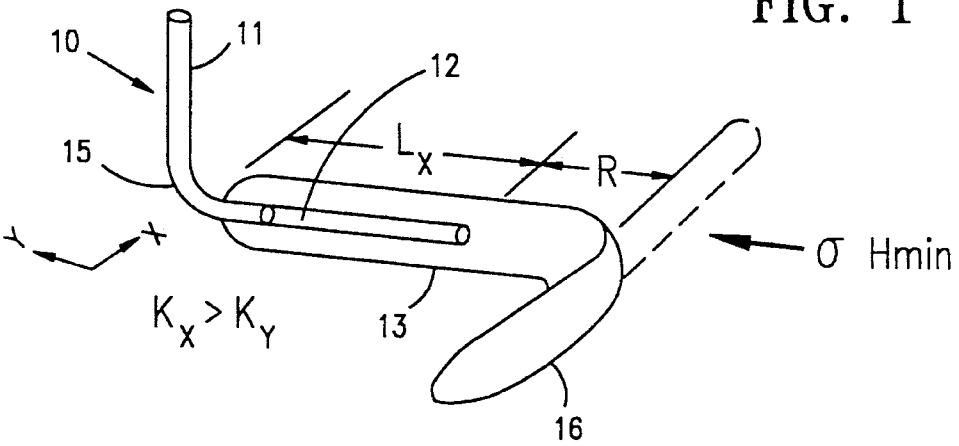
FIG. 1 is a perspective view of a horizontal wellbore with an induced fracture being guided parallel to the minimum horizontal stress in accordance with the present invention.

With reference to FIG. 1, the present invention provides for drilling a horizontal wellbore 10 parallel to the direction in which an induced fracture propagation is desired. This direction will most often be perpendicular to the high permeability trend ($K_x$) of the reservoir, and will typically be parallel to the minimum horizontal stress or low permeability trend ($K_y$). The direction of the wellbore 10 will be parallel to the direction or bearing of the minimum horizontal stress in the vast majority of cases, i.e. in at least 85% and perhaps at least 95% of formations.

A wellbore may be drilled non-parallel to the minimum horizontal stress and even perpendicular to the minimum horizontal stress in those few cases where the formation permeability in the minimum stress direction is higher and/or the breakdown pressure in the other direction is expected to be high. Breakdown pressure is the pressure at which a fracture is initialed in the formation. Other reasons for drilling in a direction not parallel to the minimum horizontal stress may be related to constraints in a lease or to unusual reservoir geometry.

The horizontal section 12 of the wellbore 10 can be completed in one or more of several ways. For example, all or a major portion of the horizontal section 12 may be openhole as shown, or have a cemented or uncemented perforated liner, or have external casing packers on a perforated or slotted liner, or be an uncemented slotted liner. However, maximum fracture direction control in accordance with the present invention is accomplished by using openhole completions. In all cases, the stress perturbation caused by the pressurized wellbore is used to guide the fracture propagation in the direction of the wellbore. As discussed above, this direction will generally be parallel to the minimum horizontal stress ($\sigma$Hmin), and thus in a direction contrary to that dictated by the in situ stress field.

R is the distance the fracture 14 is extended beyond the wellbore in an unconventional direction when practicing the present invention before turning in a conventional direction 16. L represents the length of the horizontal well where fracture is initiated. Stated another way L begins where fracture is initiated by fracturing fluid first contacting the formation and extends to the downhole end of the wellbore. In the FIG. 1 embodiment the cased portion 15 of the wellbore is perforated or otherwise open to the formation, and therefore L begins at the first perforation or opening in the casing and extends to the downhole end of an openhole portion 13. In this example, the openhole portion 13 is about 3-times the length of the cased portion 15.

The horizontal portion 12 of the wellbore 10 must be at a depth adequate to generate a vertical fracture. If too shallow a horizontal fracture may be produced. The horizontal portion may be any functional length. Further, the distance L may be from about 100 feet to about 1,000 feet, with the maximum length limited only by fluid pumping capacity and borehole diameter. Although the horizontal portion 12 of the wellbore is shown as 90° from vertical, the present invention contemplates that the "horizontal" portion may be any functional angle, and preferable from about 120 degrees to about 60 degrees from vertical measured from an imaginary line vertical line extending beneath the wellbore. Further, although FIG. 1 shows the uphole portion 11 of the wellbore as being vertical, the uphole portion 11 may be at an angle to vertical. For example, extended reach drilling modes may have shallow kick-off points or even surface entry at an angle.

Figure 2:
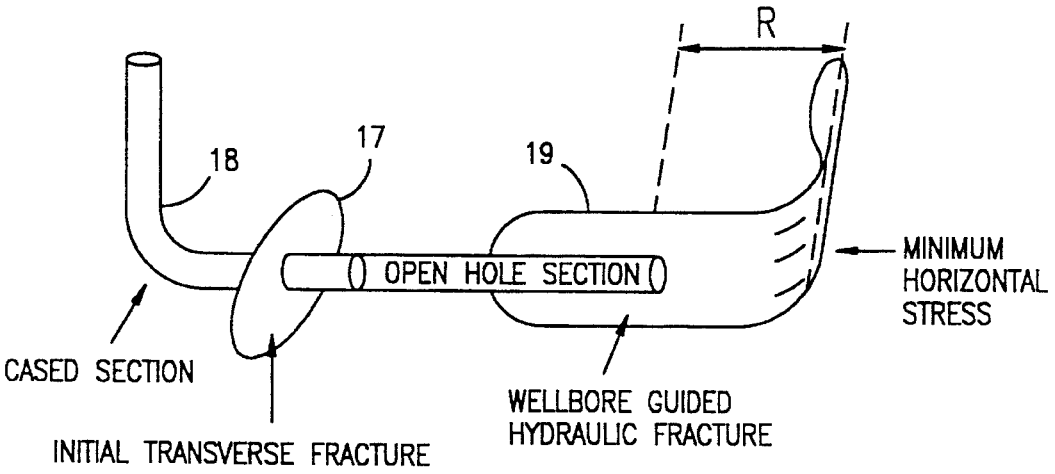
FIG. 2. is a perspective view of an another horizontal wellbore guiding a fracture after an initial transverse fracture in a cased portion to alter stresses and thereby change the horizontal stress difference.

With reference to FIG. 2., in the event that a large difference exists between the horizontal maximum and minimum stresses, for example a difference greater than about 750 psi , the stress difference can be alleviated by first inducing a fracture 17, in this example from a cased portion 18, transverse of the horizontal portion of the well, and then following with a guided hydraulic fracture 19 in accordance with the present invention. The horizontal stress difference is reduced by the first vertical fracture that is transverse to the minimum horizontal stress. The formation of the first fracture alters the local in situ stresses to reduce the horizontal stress difference. From the location of the transverse fracture 17 there must be a borehole length L equal or greater than the desired fracture length R in the borehole direction. The transverse fracture 17, need only be propped open with sand or other suitable proppant to prevent closure of the fracture. The driving force of the present invention is the direction of the wellbore, and the average net pressure provided by the pumping rate and the viscosity of the fracturing fluid.

Alternately, the pressure may be maintained in the transverse fracture while high viscosity fracturing fluid is supplied to the formation at a second depth, and at a maximum pressure to maximize the average net pressure and thereby extend the fracture in the direction of the wellbore. The in situ stress difference can be minimized by using sequential hydraulic fracturing techniques as described in U.S. Pat. Nos. 4,687,061 and 4,724,905 noted hereinabove. Both of these patents are incorporated herein by reference.

In each of the embodiments, the fracturing fluid preferably has an in situ viscosity greater than about 500 centipoises. Further, the average net pressure is at least greater than stress component normal to wellbore direction. The combined effect of net pressure generated by pumping rate and specific fracture fluid viscosity can be calculated with mathematical models.

Figure 3:
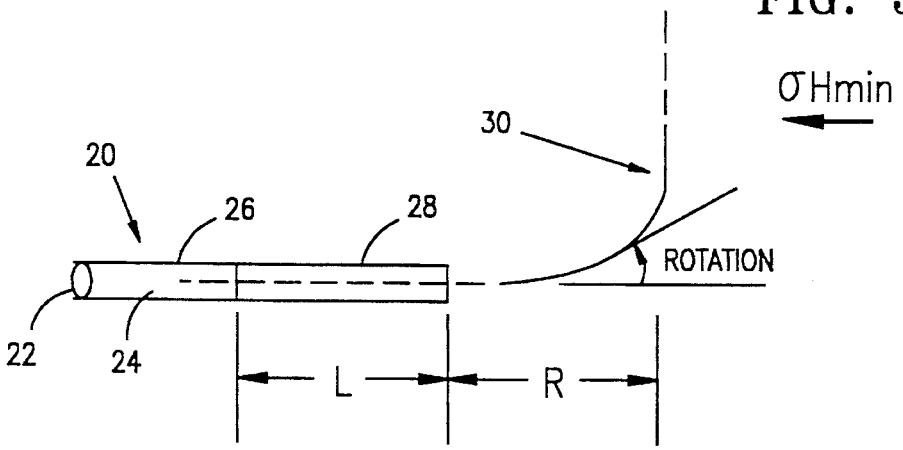
FIG. 3 is a top plan view of a horizontal wellbore guiding a fracture a distance R in accordance with the present invention before the fracture turns to a direction perpendicular to the direction of the minimum horizontal stress.

With reference to FIG. 3, there is shown another view of a horizontal well 20 having a vertical section 22, and a horizontal section 24. The horizontal section 24 has a cased or at least a partially cased portion 26, and an open hole portion 28. In this example, the cased portion is not perforated or otherwise open to the formation. Therefore, L begins at the downhole end of the casing 26 where fluid first contacts the formation. As discussed above, the horizontal section 24 is most often drilled parallel to the minimum horizontal stress, σhmin. A high viscosity fracturing fluid is introduced down the wellbore and into horizontal section at high net pressure and a high flow rate as permitted by hole and casing sizes. This flow rate can be as high as permitted by pumping equipment and wellbore diameter, for example from about 80 to about 200 barrels per minute.

The amount of the extension R of the fracture 30 is a function of the ratio of average net treating pressure ($P_{av}$) in the fracture to the horizontal stress difference (σHmax–σHmin). Thus, the wellbore acts to guide the fracture 30 for an extension distance R before the fracture turns completely perpendicular to the minimum stress, i.e. to the conventional fracture direction.

The minimum pressure to cause a fracture is greater than the minimum horizontal stress when the borehole is perpendicular to the minimum horizontal stress. The minimum net pressure must be greater than the maximum horizontal stress when the borehole is perpendicular to this stress. Thus, the minimum net pressure to extend the fracture in any given direction in accordance with the present invention must be greater than the stress component acting normal to the wellbore direction.

The average net treating pressure is the average of well pressures over the duration of the fracture treatment in the fracture, and is proportionally defined by:

$$P_{av} \alpha \left( \frac{Q^m}{\sigma Hmax - \sigma Hmin} \right);$$

wherein $P_{av}$=average net treating pressure, psi, $Q^m$=injection rate, bbls/min, m=constant defined by model used, σHmax=maximum horizontal stress pressure, psi, and σHmin=minimum horizontal stress pressure, psi.

The average net treating pressure is preferably between about 500 psi and about 2,000 psi greater than the normal component of the horizontal stress. Typical normal components may be in the order of 2,000 to 6,000 psi, depending upon the wellbore depth. The progress of the fracture or the borehole direction can be monitored by surface tilt meters, or by known microseismic methods such as that disclosed in U.S. Pat. No. 5,187,332, which is incorporated herein by reference. L is in the order of about 500 to about 2,000 feet, R is in the order of about 50 feet to about four times L.

The invention also contemplates repeating the steps of the broad aspect of the invention to incrementally propagate the fracture further beyond the downhole end of the wellbore. Thus, there is repeated in sequence and as needed the steps of drilling in a desired fracture direction, supplying fracturing fluid, and maintaining (preferably maximizing) the average net treating pressure at a level at least greater than the horizontal stress difference. This aspect also comprises monitoring the propagation of the fracture beyond the end of the wellbore, and performing the repeating steps after the fracture is at a maximum distance beyond the end of the wellbore. However, these steps may be repeated after the fracture curves to a direction parallel to the direction of the high permeability trend of the formation, whereby local in situ stresses are altered after the fracture curves.

Figure 4:
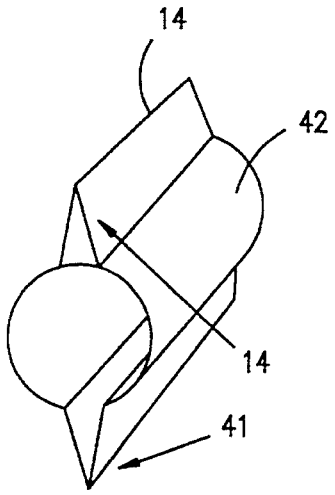
FIG. 4 is a perspective view of a notched openhole to enhance guidance of a fracture along and in the direction of the wellbore.
Figure 5:
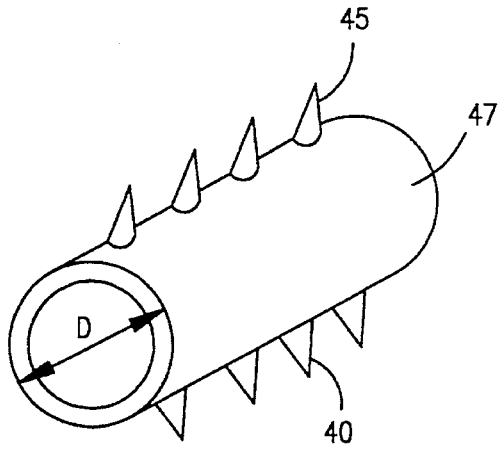
FIG. 5 is a perspective view of a portion of a casing with perforation arrays for guiding a fracture along and in the direction of a cased wellbore.

In open hole cases where there is formation permeability anisotropy and open natural fractures are present, forming notches 14,41 along the upper and lower portions of the wellbore 42 as shown in FIG. 4 will enhance the probability of fracture guidance along the high and low side of the wellbore. A typical wellbore diameter is from about 4.5 to about 10.5 inches. A notch depth of at least one wellbore diameter with a width of about 0.25" is preferred. The notches can be made with a hydrojet nozzle using abrasive material, or with shaped tape changes. In a cased wellbore, fracture guidance is enhanced by two lined arrays 45,40 of perforations along the high and low sides of the wellbore 47, as shown in FIG. 5. A perforation spacing of less than one wellbore diameter is preferred when using penetrating charges.

Generally, it is impractical to treat a wellbore section longer than 500 feet in an openhole situation because of fluid leak-off into the formation, and pumping rate limitations of available equipment, conduits and wellbore size. Potential wellbore stability problems are also substantial. However, wellbore stability problems in openhole applications may be overcome by using a perforated uncemented liner, or by using an uncemented liner slotted in the longitudinal direction.

In order to avoid excessive leak off in horizontal openhole wells of greater than 500 feet, zonal isolation may be used. Zonal isolation can be obtained by using a cemented or uncemented perforated liners at spaced locations along the borehole. Alternatively, external casing packers can be used in conjunction with either a perforated liner, or alternating slotted and solid liners. Any zonal isolation system must provide short intervals for fracture initiation with longer intervals in between to reduce leak-off.

With reference to FIG. 5 a perforated completion in accordance with the present invention is prepared by spacing perforations 40,45 in a casing no more than one wellbore diameter apart to ensure fracture link-up along the wellbore. Further, such perforations should be made in a vertical plane at an 180° phasing on the high side and the low side of the wellbore, and intersecting the wellbore trend to provide for initiation of a fracture in that plane. Still further, and if feasible, perforated intervals should continue for all the guiding portion of the casing. The spacing between perforations along the wellbore can vary depending upon the net pressure to stress difference ratio. For ratios higher than 4, the spacing section can be up to 5 times the diameter of the wellbore. Specifically, the spacing between each adjacent perforation preferably does not exceed S, as defined by:

$$S = \left( \frac{P_{av}}{\sigma Hmax - \sigma Hmin} \right) d;$$

wherein

S=distance between perforations, ft, $P_{av}$=average net treating pressure in fracture,psi, σHmax=maximum horizontal stress pressure, psi, σHmin=minimum horizontal stress pressure, psi, and d=diameter of borehole, ft.

In accordance with another embodiment of the present invention, completions may be made using external casing packers. These packers are used to support and space the liner from the borehole. Such use is analogous to the above describe perforated completion where alternating zones between external casing packers will take fluid during fracture treatment. External casing packers serve to isolate a portion of the openhole from the fracturing pressure, and the fracture is then guided only along the open section between the packers. Fractures guided from each side of an external casing packer will join in high net pressure cases.

The objective of the present invention is to propagate the induced fracture as far as possible and desired in the wellbore parallel direction before the in situ stress field takes over and the fracture curves back to a conventional induced fracture direction. This conventional induced fracture direction most often is perpendicular to the minimum horizontal stress and parallel to the natural fracture trends. As discussed above, success of fracture direction control in accordance with the present invention is primarily determined by two parameters. The first parameter is the average net treating pressure in the fracture during pumping, and the other parameter is the in situ horizontal stress difference. The higher the net pressure relative to the horizontal stress difference, the greater the fracture extension in the desired direction.

Figure 6:
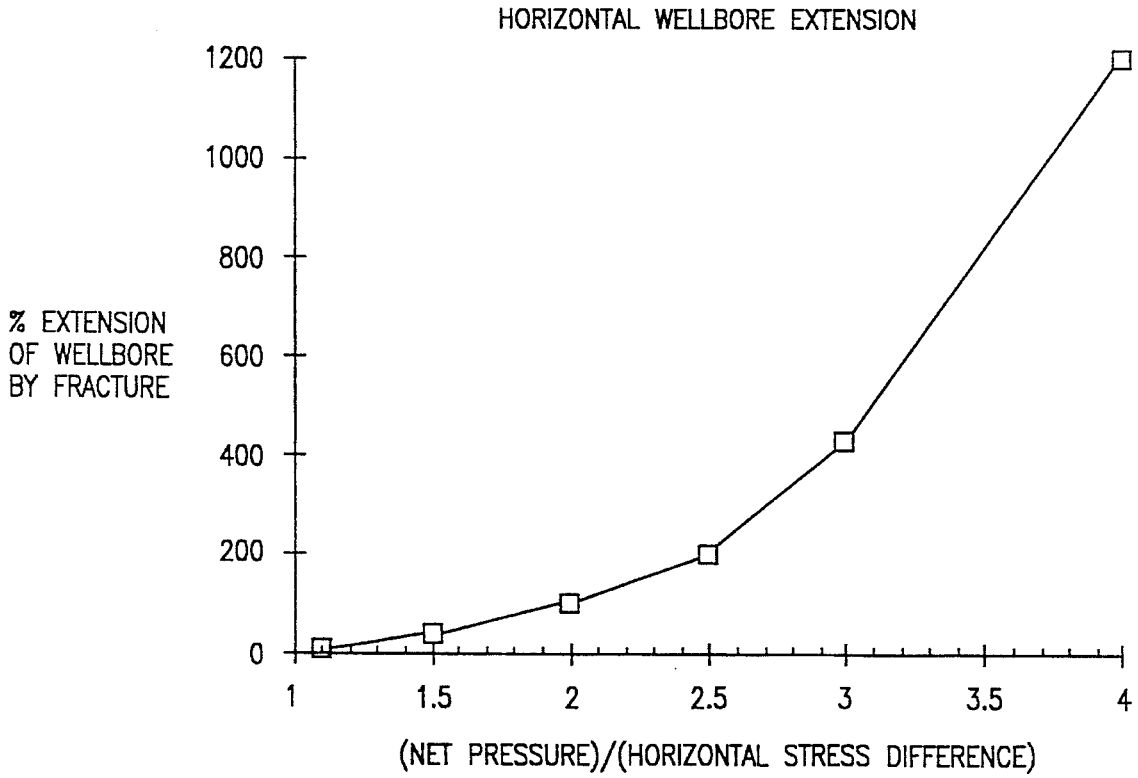
FIG. 6 is a graph of data points generated by a computer model of a subterranean formation which shows the relationship between net pressure, horizontal stress difference, and wellbore fracture extension for the wellbore of FIG. 1.

The relationship between net pressure, horizontal stress difference, and wellbore parallel fracture extension for a horizontal well drilled parallel to the minimum horizontal stress is shown in FIG. 6. It can be seen that the extension of the fracture beyond the end of the wellbore is defined by:

$$R \text{ is a function of } \left( \frac{P_{av}}{\sigma Hmax - \sigma Hmin} \right);$$

wherein

R=distance fracture extends beyond wellbore,ft, $P_{av}$=average net treating pressure in fracture,psi σHmax=maximum horizontal stress pressure, psi, and σHmin=minimum horizontal stress pressure, psi.

With reference to FIG. 6, it will be seen that the results range from 10% wellbore parallel extension for a net pressure to stress difference ratio of 1.1 to 1,200% extension for a net pressure to stress difference ratio of 4. Thus, the average net pressure and the horizontal stress difference is preferably maintained in a ratio of:

$$\frac{P_{av}}{\sigma Hmax - \sigma Hmin} \geqq 1.5$$

Accordingly, the process of the present invention is optimized by maximizing the average net treating pressure of the fracturing fluid and by minimizing the in situ stress difference. Maximization of the net pressure may be accomplished in essentially two ways. First, a maximum pumping rate is used. Secondly, a high viscosity fracturing fluid is also used. Since the effects of both high fluid viscosity and high pumping rate increase the net pressure, optimum conditions are selected depending on the borehole size, depth, temperature, formation properties, and equipment pressure limitations. However, delayed cross-linking fracturing fluid is preferred so that the viscosity is low while pumping the fracturing fluid down the wellbore to minimize pipe friction pressures, and that the viscosity increases in situ.

There are several known reliable techniques available in the industry to determine the direction and magnitude of the in situ stresses. For example an openhole may be microfractured followed by use of borehole imaging tools such as a borehole televiewer (BHTV) or a formation microscanner (FMS) such as that manufactured by Schlumberger Tool Co. Further, an elastic strain analysis on freshly retrieved oriented cores will provide information on the direction and magnitude. Differential strain analysis on freshly cut or old oriented cores will also give an indication of such information.

Figure 7:
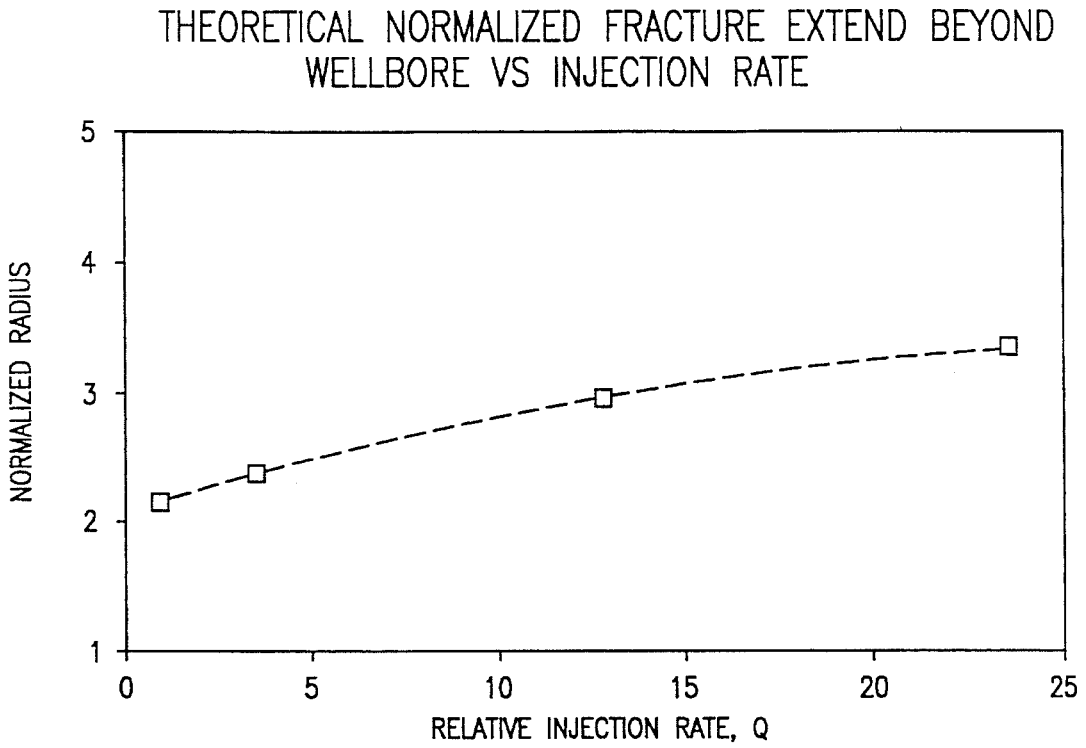
FIG. 7 is a graph of data points generated by a computer model of a subterranean formation which shows the fracture guided length beyond the wellbore normalized by wellbore length versus injection rate increase.

FIG. 7 is a graph of data points generated by a computer model of a subterranean formation which shows the fracture guided length beyond the wellbore normalized by wellbore length, R/L, versus injection rate increase.

Figure 8:
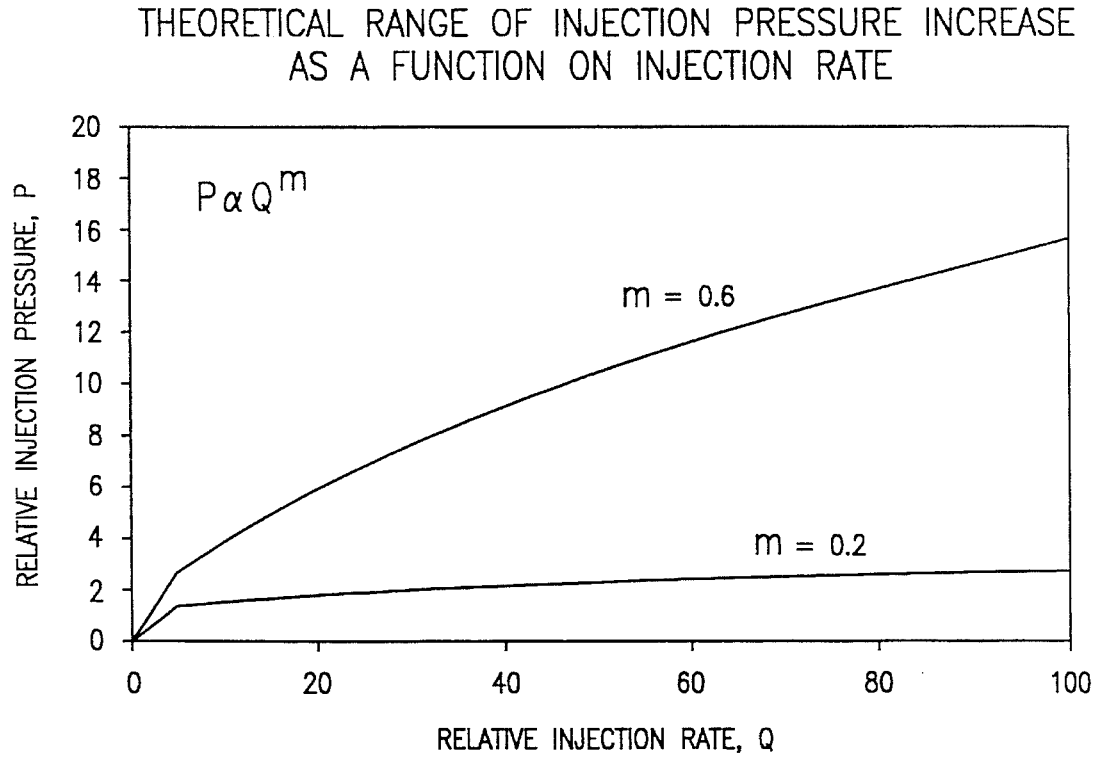
FIG. 8 is a graph showing how injection pressure varies with respect to injection rate.

FIG. 8 shows curves derived from theoretical models of subterranean formations that relate the relative injection pressure, P, (psi) to the relative injection or pumping rate, Q, (bbls/min) for different models. The different formation models are incorporated in the proportional equation $P \alpha Q^m$ by m the power of Q. m ranges from about 0.2 to about 0.6, depending whether the model is circular, rectangular, elliptical or some combination thereof. A circular fracture, such as the transverse fracture 17 in FIG. 2 has a m of 0.2. An elliptical fracture has a m of 0.6. The borehole guided fractures 13,19 of FIGS. 1 and 2 are substantially elliptical.

Figure 9:
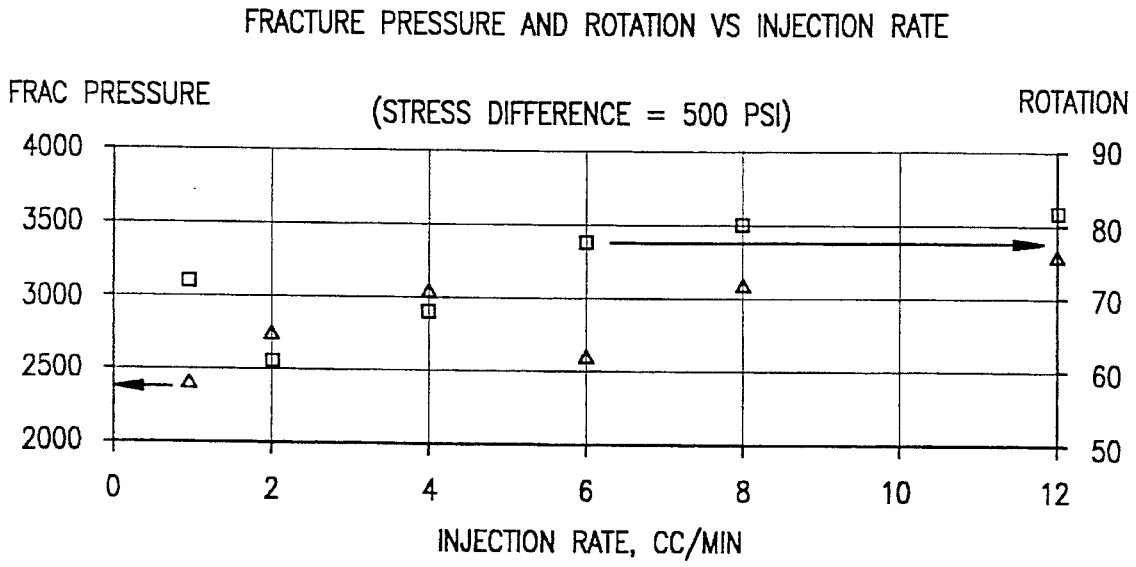
FIG. 9 is a graph of experimental data showing the relationships between fracture pressure, fracture rotational angle, and injection rate when practicing the present invention.

FIG. 9 shows the relationship between fracture pressure and rotation, and injection rate using synthetic rock material or hydrostone with a stress difference of 500 psi. FIG. 9 plots experimental observations which confirm the curves of FIG. 8, wherein fracture pressure on the left Y-axis increases as the injection rate increases. Furthermore, the rotation angle flattens with less curvature as the injection rate increases (see FIG. 3). The triangles are fracture pressure increases associated with injection rate increases. The squares show the relationship between the rotation angle (FIG. 3) and the injection rate. The rotation angles in the right vertical axis of FIG. 9 are equal to the complement of the rotation angle shown in FIG. 3.

Figure 10:
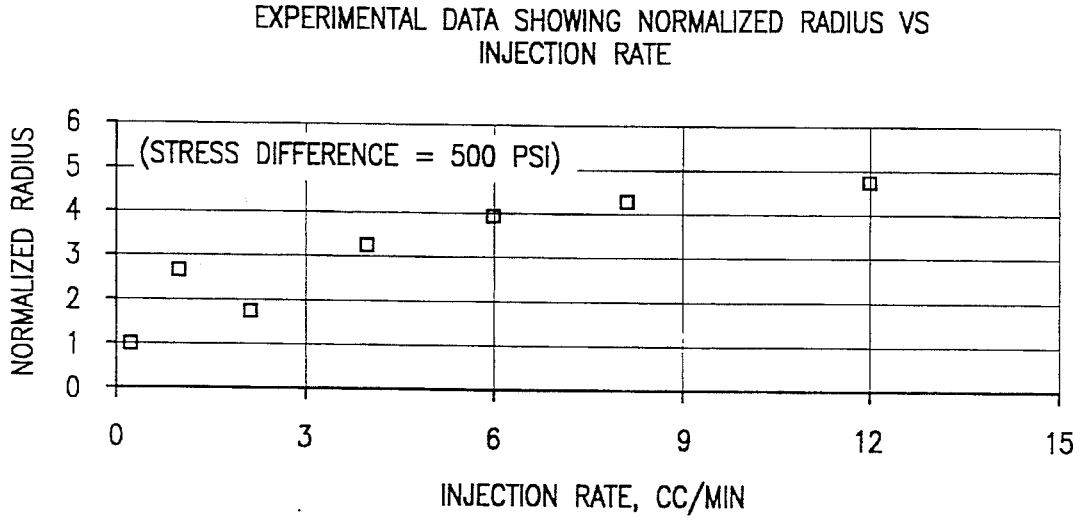
FIG. 10 is a graph showing the relationship between injection rate and normalized radius when practicing the present invention.

FIG. 10 shows the relationship of normalized radius, R/L, and injection rate. As noted above, normalized radius is the fracture length beyond the end of the wellbore divided by the length of the horizontal portion of the wellbore. This, experimental data clearly shows that the higher the injection rate, the greater the extension of the fracture in the direction of the wellbore. FIG. 10 is experimental data from the same experiments which generated the graphs of FIG. 9. Synthetic rock blocks and their use are shown and described in U.S. Pat. No. 4,724,905.

As discussed above, one of the goals of this invention is to extend the fracture along the axis of the wellbore and delay curving as long as possible. Nonetheless when that curving does occur, there is a unique stress loading at the top and bottom of the fracture (termed mixed mode I-III loading in the fracture mechanics literature) that limits height growth. The top and bottom of the fracture break down in en-echelon segments, reducing the stress concentration at those tips available for propagation, and fracture extension is diverted mainly to lateral growth. The faster the fracture turning, the more severe the height limitation. In thin reservoirs where height growth is undesirable, this technique can be used to concentrate fracture growth in the pay zone.

Practicing the present invention maximizes communication between the wellbore and the induced fracture for production purposes. In cases where fractures are propagated transverse to the horizontal wellbore, there is a severe flow restriction where the fluids converge at the well. However, this is not a problem when the fracture, as generated in accordance with the present invention, runs down the formation parallel to the axis of the well. Also, by slowing the rate of turn of the fracture it is easier to pump proppant into the created fracture without premature screen-outs. Therefore, drilling the wellbore in a desired direction in accordance with the present invention to guide the induced fracture aids in the execution of all treatments of highly deviated or horizontal wellbores. For example, in an offshore platform where extended reach holes are drilled radially from a central site, instead of re-orienting the hole in a vertical direction through the pay zone to improve fracture treatment logistics, the hole should be drilled as close to horizontal as possible to enable wellbore guiding effects to generate a relatively planar and vertical fracture geometry at least substantially parallel to the wellbore trend. This wellbore would be completed with one of the techniques mentioned in the disclosure above to ensure proper fracture propagation. Extended reach hole drilled in the direction of the minimum stress represent the extreme case of wellbore guided hydraulic fracture technique presented in this invention, where fracture direction desired is not orthogonal to the wellbore as commonly used.

While the invention has been described in conjunction with specific embodiments thereof, it is evident that many alternatives, modifications, and variations will be apparent to those skilled in the art in light of the foregoing description. Accordingly, it is intended to embrace all such alternatives, modification, and variations as fall within the spirit and broad scope of the appended claims.

What is claimed is:

1. A method of controlling the direction of a hydraulic fracture induced from a highly deviated wellbore comprising the steps of:

(a) drilling a highly deviated wellbore in a formation in a direction parallel to a desired fracture direction;

(b) supplying fracturing fluid through said wellbore to induce a hydraulic fracture in said formation; and (c) maintaining in said hydraulic fracture an average net treating pressure at least greater than the maximum horizontal stress pressure less the minimum horizontal stress pressure to extend said hydraulic fracture beyond the end of the wellbore;

steps (b) and (c) being performed without a vertical fracture being initially formed that is transverse to the minimum horizontal stress.

2. The method of claim 1 wherein step (c) the average net treating pressure is maximized in the fracture formed in said formation by pumping said fracturing fluid at a maximum rate and by said fracturing fluid being in situ a high viscosity fracturing fluid.

3. The method of claim 1 further comprising adjusting the ratio of the average net treating pressure to the horizontal stress difference, whereby the higher the ratio, the greater the amount of the extension.

4. The method of claim 1 wherein the average net pressure and the horizontal stress difference are in the ratio of:

$$\frac{P_{av}}{\sigma Hmax - \sigma Hmin} \geqq 1.5;$$

wherein $P_{av}$=average net treating pressure in fracture,

σHmax=maximum horizontal stress pressure, and

σHmin=minimum horizontal stress pressure.

5. The method of claim 1 wherein the extension of the fracture beyond the end of the wellbore is defined by:

$$R = f\left(\frac{P_{av}}{\sigma Hmax - \sigma Hmin}\right);$$

wherein

R=distance fracture extends beyond wellbore, $P_{av}$=average net treating pressure in fracture, σHmax=maximum horizontal stress pressure, and σHmin=minimum horizontal stress pressure.

6. The method of claim 1 wherein the deviated portion of said wellbore is at least substantially horizontal.

7. The method of claim 1, wherein the fracturing fluid has an in situ viscosity greater than about 500 centipoises.

8. The method of claim 1, wherein the deviated wellbore has a horizontal portion, and wherein the horizontal portion is drilled parallel to the direction of the minimum horizontal in situ stress pressure.

9. The method of claim 1, wherein the deviated wellbore has a horizontal portion, and wherein the horizontal portion is drilled perpendicular to the high permeability trend of the formation.

10. The method of claim 1, wherein the direction of the wellbore is transverse to the direction of the high permeability trend of the formation.

11. The method of claim 1 further comprising prior to step (a) determining permeability trends of the formation, and said drilling direction being transverse to the direction of the high permeability trend.

12. The method of claim 1 further comprising prior to step (a) determining the magnitude and direction of in situ stresses in the formation, and said drilling direction being transverse to the bearing of the maximum horizontal stress pressure.

13. The method of claim 1 wherein the wellbore includes casing at least a portion of the deviated portion, further comprising forming a lined array of perforations along each of the high side and low side of the casing in the deviated portion for enhancing guidance of the fracture in the direction of the wellbore.

14. The method of claim 13 wherein the spacing between each adjacent perforation is less than the diameter of the wellbore.

15. The method of claim 13 wherein the spacing between each adjacent perforation does not exceed S as defined by:

$$S=\left(\frac{P_{av}}{\sigma Hmax-\sigma Hmin}\right)d;$$

wherein

S=distance between perforations, $P_{av}$=average net treating pressure in fracture, psi, σHmax=maximum horizontal stress pressure, psi, σHmin=minimum horizontal stress pressure, psi, and d=diameter of borehole.

16. The method of claim 1 wherein at least a part of the deviated portion of the wellbore is an openhole, further comprising forming longitudinally extending notches along the upper and lower portions of the openhole part of the wellbore for enhancing guidance of the fracture in the direction of the wellbore.

17. The method of claim 16 wherein the depth of the notches is at least equal to one diameter of the wellbore and the width of the notches is from about 0.1 inch to about 0.5 inch.

18. The method of claim 1 further, comprising the steps of repeating steps (a) through (c) to incrementally propagate the fracture beyond the downhole end of the wellbore.

19. The method of claim 18 further, comprising monitoring the propagation of the fracture beyond the end of the wellbore, and repeating steps (a) through (c) after the fracture is at a maximum distance beyond the end of the wellbore.

20. The method of claim 18 further comprising repeating steps (a) through (c) after the fracture curves to a direction parallel to the bearing of the high permeability trend of the formation, whereby local in situ stresses are altered after the fracture curves.

* * * * *